US006074134A

United States Patent [19]

Stankus et al.

[11] Patent Number: 6,074,134

[45] Date of Patent: Jun. 13, 2000

[54] TENSIONABLE CABLE BOLT

[75] Inventors: John C. Stankus, Canonsburg, Pa.; Kendal L. Taylor, Masontown, W. Va.

[73] Assignee: Jennmar Corporation, Pittsburgh, Pa.

[21] Appl. No.: 09/019,643

[22] Filed: Feb. 6, 1998

Related U.S. Application Data

[60] Provisional application No. 60/038,187, Feb. 14, 1997, provisional application No. 60/052,567, Jul. 15, 1997, and provisional application No. 60/066,266, Nov. 20, 1997.

[51] Int. Cl.[7] ..... E21D 20/02

[52] U.S. Cl. ..... 405/259.6; 405/259.1; 405/302.2; 411/8; 411/82

[58] Field of Search ..... 405/259.1, 259.5, 405/259.6, 302.2, 288, 262; 411/8, 82

[56] References Cited

U.S. PATENT DOCUMENTS

| | | | |
|---|---|---|---|
| D. 301,687 | 6/1989 | Cassidy et al. | D8/399 |
| 2,748,594 | 6/1956 | Edwards | 72/105 |
| 2,850,937 | 9/1958 | Ralston . | |
| 2,970,444 | 2/1961 | Peter | 405/302.2 |
| 3,133,468 | 5/1964 | Cumming . | |
| 3,224,202 | 12/1965 | Durget . | |
| 3,238,731 | 3/1966 | Seifert et al. . | |
| 3,329,058 | 7/1967 | Cumming . | |
| 3,478,523 | 11/1969 | Reusser et al. . | |
| 4,037,418 | 7/1977 | Hannan . | |
| 4,095,430 | 6/1978 | Hannan . | |
| 4,095,431 | 6/1978 | Hannan . | |
| 4,112,693 | 9/1978 | Collin et al. | 405/132 |
| 4,445,808 | 5/1984 | Arya | 405/259.6 |
| 4,652,178 | 3/1987 | Kates et al. | 405/259.6 |
| 4,704,053 | 11/1987 | Hipkins, Sr. et al. | 405/259.6 |
| 4,708,559 | 11/1987 | Locotos | 411/545 |
| 4,790,129 | 12/1988 | Hutchins | 57/204 |
| 5,078,547 | 1/1992 | Calandra, Jr. et al. | 405/259.5 |
| 5,181,800 | 1/1993 | Stankus et al. | 405/259.6 |
| 5,192,146 | 3/1993 | Landsberg | 405/259.1 |
| 5,244,314 | 9/1993 | Calandra, Jr. et al. | 405/259.4 |
| 5,259,703 | 11/1993 | Gillespie | 405/259.6 |
| 5,288,176 | 2/1994 | Huff et al. | 405/259.6 |
| 5,344,256 | 9/1994 | Hedrick | 405/259.1 |
| 5,375,946 | 12/1994 | Locotos | 405/259.4 |
| 5,378,087 | 1/1995 | Locotos | 405/259.5 |
| 5,525,013 | 6/1996 | Seegmiller et al. | 405/259.3 |
| 5,531,545 | 7/1996 | Seegmiller et al. | 405/259.4 |
| 5,556,233 | 9/1996 | Kovago | 405/259.4 |
| 5,586,839 | 12/1996 | Gillespie | 405/259.1 |

FOREIGN PATENT DOCUMENTS

| | | | |
|---|---|---|---|
| 1143471 | 2/1963 | Germany | 405/302.2 |

OTHER PUBLICATIONS

Bureau of Mines Information Circular/1994, "Cable Bolt Support Technology in North America", pp. 6–11, Goris et al.

Product Report 102 BLM Mincon Inc. 1–92, "Preformed Cable Anchor", pp. J01680–83.

*Primary Examiner*—Dennis L. Taylor

*Attorney, Agent, or Firm*—Webb Ziesenheim Logsdon Orkin & Hanson, P.C.

[57] ABSTRACT

A tensionable mine roof cable bolt having a resin grouted upper portion and a mechanically anchored lower portion. The lower portion includes a shaft which is swaged to the cable and accepts a mechanical anchor. The cable bolt is rotated during installation in a mine roof bore hole to mix resin and simultaneously engage the mechanical anchor with the rock. A drivehead press fitted onto the lower end of the cable fails upon tensioning of the bolt to a predetermined load.

25 Claims, 2 Drawing Sheets

TENSIONABLE CABLE BOLT

This application claims the benefits of U.S. Provisional Application Ser. No. 60/038,187 entitled "Tensionable Cable Bolt" filed Feb. 14, 1997 and U.S. Provisional Application Ser. No. 60/052,567 entitled "Tensionable Cable Bolt" filed Jul. 15, 1997 and U.S. Provisional Patent Application Ser. No. 60/066,266, entitled "Tensionable Cable Bolt" filed Nov. 20, 1997.

BACKGROUND OF THE INVENTION

1. Field of the Invention

The present invention relates to tensionable cable mine roof bolts, in particular, a tensionable cable mine roof bolt having a tension indicator which is adapted to be grouted and mechanically anchored in a mine roof bore hole.

2. Prior Art

Cable mine roof bolts are gaining popularity in the mining industry for their ease of handling and installation. Cable bolts are substantially easier to fit into a bore hole than the elongated rods of conventional rod bolt systems. Regardless of the height limitations in a mine, cable bolts may be adapted to bore holes of any length due to their flexibility. The strength capacity of cables exceeds that of conventional rod bolts and, therefore, cable is the preferred reinforcement for certain roof conditions.

Conventional cable mine roof bolts are installed by placing a resin cartridge including catalyst and adhesive material into the blind end of a bore hole, inserting the cable bolt into the bore hole so that the upper end of the cable bolt rips open the resin cartridge and the resin flows in the annulus between the bore hole and the cable bolt, rotating the cable bolt to mix the resin catalyst and adhesive and allowing the resin to set about the cable bolt. Typically, the resin is set after two to three minutes. Cable bolts have heretofore been primarily used as secondary roof support structures with tensionable rock bolts serving as the primary anchorage mechanism.

Tensionable cable bolts are the subject of U.S. Pat. No. 5,378,087 to Locotos and U.S. Pat. No. 5,525,013 to Seegmiller et al. Each of the bolts described therein are resin grouted at the blind end of a bore hole and following setting of the resin, they are tensioned by rotation of a nut on an externally threaded sleeve surrounding the free end of the cable. U.S. Pat. No. 5,531,545 to Seegmiller et al. and U.S. Pat. No. 5,556,233 to Kovago both disclose tensionable bolts with a mechanical anchor mounted on the upper end of the cable bolt and tensioning mechanisms disposed on their free ends for post-installation tensioning. Although these prior art cable bolts are tensionable, they require two installation steps; namely, a first step to anchor the upper end of the cable bolt in the bore hole and a second step to tension the bolt.

U.S. Pat. No. 5,375,946 to Locotos discloses a cable bolt having a shaft connected at its upper end, the shaft bearing an expansion anchor. Anchorage of the bolt occurs primarily at the upper end of the bolt by action of the expansion anchor and resin. Thus, anchorage occurs only at the blind end of the bore hole in the vicinity of the expansion anchor and the resin. Another drawback to the bolt is that it is difficult to determine the amount of tension exerted upon the bolt during installation.

It is an object of the present invention to provide a tensionable cable bolt having a plurality of locations of anchorage within a bore hole and which is tensionable to a predetermined load.

SUMMARY OF THE INVENTION

This object is met by the tensionable cable mine roof bolt of the present invention. The cable bolt includes an elongated member having an upper portion adapted to be resin grouted within a bore hole in rock and a lower portion adapted to be mechanically anchored to the rock. The upper portion includes a length of multi-strand cable, whereby when the elongated member is rotated the lower portion anchors to the rock thereby tensioning the bolt and the upper portion simultaneously mixes resin within the bore hole. A drivehead is attached, such as by press fitting, to a lower end of the elongated member. When resin is inserted into the bore hole and the drivehead is rotated, the upper portion rotates and mixes the resin and the lower portion anchors to the rock.

The cable includes a first end, a second end and a mixing portion disposed between the first and second ends. The bolt lower portion includes an externally threaded shaft, preferably with twelve threads per inch, attached to the cable and a mechanical anchor threaded onto the threaded shaft. The shaft is hollow and the cable extends through the shaft. The shaft may be swaged to the cable. Alternatively, the bolt may include a coupler body coupling the cable to the threaded shaft.

A barrel and wedge assembly is attached to the cable between the drivehead and the shaft. The drivehead is adapted to break away from the cable when the bolt is tensioned to a predetermined load.

The cable includes a plurality of strands wrapped around each other. The mixing portion includes a region of the cable wherein the strands are spaced apart from each other. Preferably, the mixing portion includes a plurality of regions in which the strands are spaced apart from each other. The cable further includes a central strand and a plurality of surrounding strands and the bolt further includes a nut, the nut being received on the central strand in one of the mixing regions at a position about three feet from the cable second end. A sleeve is mounted on the cable second end whereby the ends of each strand are fixed relative to each other within the sleeve.

The present invention further includes a tensionable cable mine roof bolt for insertion into a bore hole in rock and adapted to be resin grouted. The cable bolt includes a bearing plate, a barrel and wedge assembly supporting the bearing plate, and a multi-strand cable having a first end which is attached to the barrel and wedge assembly. The cable includes a resin mixing portion positioned on the cable distal from the first end. A drivehead is releasably mounted on the first end of the cable opposite the barrel and wedge assembly from the bearing plate. An externally threaded shaft is mounted on the cable between the bearing plate and the resin mixing assembly, and a mechanical anchor is threaded onto the shaft. The shaft may be swaged to the cable. When the bolt is rotated within the bore hole to mix the resin, the mechanical anchor engages the rock to permit tensioning of the bolt. The drivehead may be press fitted onto the cable and may be adapted to break away from the cable when the bolt is tensioned to a predetermined load.

The mixing portion includes a plurality of regions wherein the strands of the cable are spaced apart from each other. The cable includes a central strand and a nut is received on the central strand in one of the mixing regions. Prior to installation of the bolt in the bore hole, an outside diameter of one of the mixing regions is larger than an inside diameter of the bore hole.

The present invention also includes a method of installing a cable mine roof bolt in a bore hole formed in the rock of the mine roof having the steps of placing a resin cartridge into the bore hole; inserting the cable mine roof bolt into the bore hole, the bolt having a drivehead mounted on the bolt at a first end thereof, the cable including a resin mixing portion distal from the first end, the bolt further including a mechanical anchor mounted on the bolt at a position between the drivehead and the resin mixing portion; and rotating the drivehead to simultaneously rotate the resin mixing portion and to engage the mechanical anchor with the rock thereby tensioning the bolt. The inventive method further includes tensioning the bolt to a predetermined load by rotating the drivehead until the drivehead breaks free from the cable.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
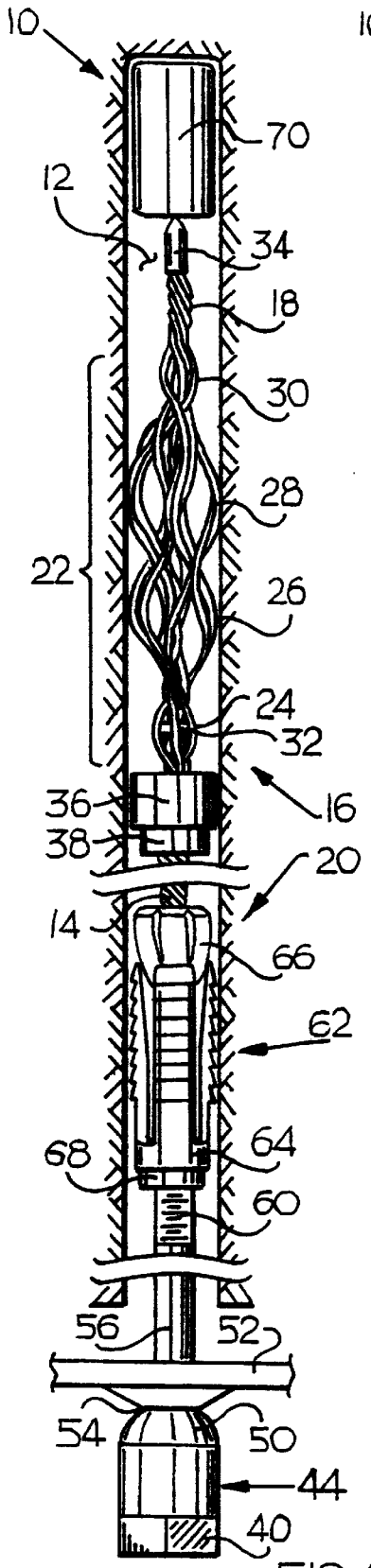
FIG. 1 is a side elevation view of the tensionable cable mine roof bolt, made in accordance with the present invention, illustrating a resin capsule advanced ahead of the cable bolt in a bore hole.

For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

FIG. 1 illustrates a tensionable cable mine roof bolt 10 made in accordance with the present invention. The cable bolt 10 is adapted to be inserted into a drilled bore hole 12 of a rock formation to support the rock formation, such as a mine roof overlaying a mine shaft and the like.

The bolt 10 includes a cable 14 adapted to be received within the bore hole 12. The cable 14 is preferably formed of a galvanized steel strand conforming to ASTM designation A 416 entitled, "Standard Specification for Steel Strand Uncoated Seven Wire for Prestressed Concrete". The cable 14 is generally of a seven-strand type having a central strand enclosed tightly by six helically placed outer strands where the uniform pitch is between twelve and sixteen times the nominal diameter of the cable 14. The cable 14 is generally referred to by grade, with Grade 250 corresponding to an ultimate strength of 250,000 psi and Grade 270 corresponding to an ultimate strength of 270,000 psi.

An upper portion 16 of the cable 14, including an anchored end 18, is adapted to be resin grouted within the bore hole 12 while a lower portion 20 is adapted to be mechanically anchored within the bore hole 12. The upper portion 16 includes a mixing portion 22 for mixing resin within the bore hole 12. The mixing portion 22 includes a plurality of, preferably four, bird cages 24, 26, 28 and 30 positioned at spaced locations along the upper portion 16 of the bolt 10. The bird cages 24, 26, 28 and 30 are regions of the cable 14 where the strands of the cable 14 have been unwrapped and separated from each other. A nut or washer 32 is positioned on the central strand of the cable 14 in the bird cage 24. The nut 32 maintains spacing between the central strand and the surrounding strands in the bird cage 24 and helps to prevent the strands in the bird cages 26, 28 and 30 from wrapping back into the original helical configuration of the cable 14. The provision of bird cages 24, 26, 28 and 30 improves the mixing of the resin during installation as well as increasing the bond strength of the resulting anchorage. Preferably, before installation in the bore hole 12, the bird cages 26 and 28 each have outer dimensions which are larger than an internal diameter of the bore hole 12. Upon installation, the bird cages 26 and 28 compress slightly such that outer strands of the cable 14 abut against the bore hole wall. The bird cages 26 and 28 provide enhanced resin mixing over conventionally sized bird cages (having outer dimensions smaller than the bore hole inside diameter) because the individual strands are substantially diametrically spaced across the bore hole thus ensuring that resin located near or at the bore hole wall is mixed as well as resin located closer to the center of the bore hole. The outer strands which abut against the bore hole wall also serve to center the bolt 10 within the bore hole further enhancing even mixing of the resin and resulting in a uniform annulus of resin surrounding the cable.

The bird cages 24, 26, 28 and 30 preferably are made by opening the anchored end 18 of the cable 14 with a spreading tool such as the spreader disclosed in U.S. Pat. No. 5,699,572, granted Dec. 23, 1997 incorporated herein by reference. The spreading tool separates the central strand from the surrounding strands, and the cable is unwound for about three feet. A nut or washer is placed over an end of the central strand and slid along the central strand to a position about thirty-five to thirty-six inches from the end of the central strand. A sleeve or button 34 is crimped or swaged onto the ends of the spread apart strands. The amount of cable which is unwound and the position of the nut determines the size and characteristics of the bird cages. It has been found that when the cable is unwound about three feet and the nut is placed within a few inches of the remaining wound portion of the cable, two larger bird cages 26 and 28 flanked by two smaller bird cages 24 and 30 form in the cable 14. Three feet of bird caged cable has been determined to provide sufficient resin mixing and resin anchorage for the cable bolt 10.

Figure 2:
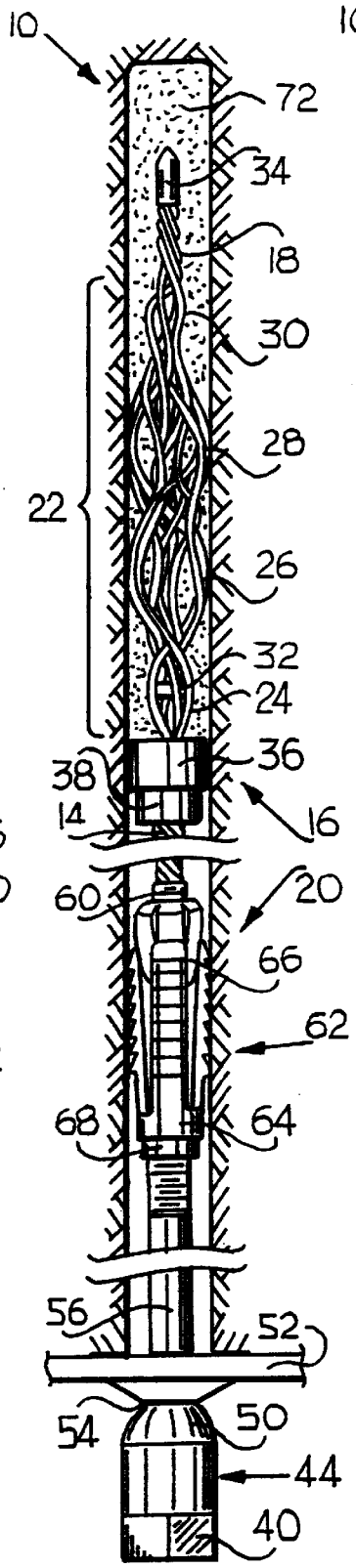
FIG. 2 is another side elevation view of the cable bolt shown in FIG. 1, illustrating rupture of the resin capsule and mixing of the resin components in the bore hole via a drivehead.
Figure 3:
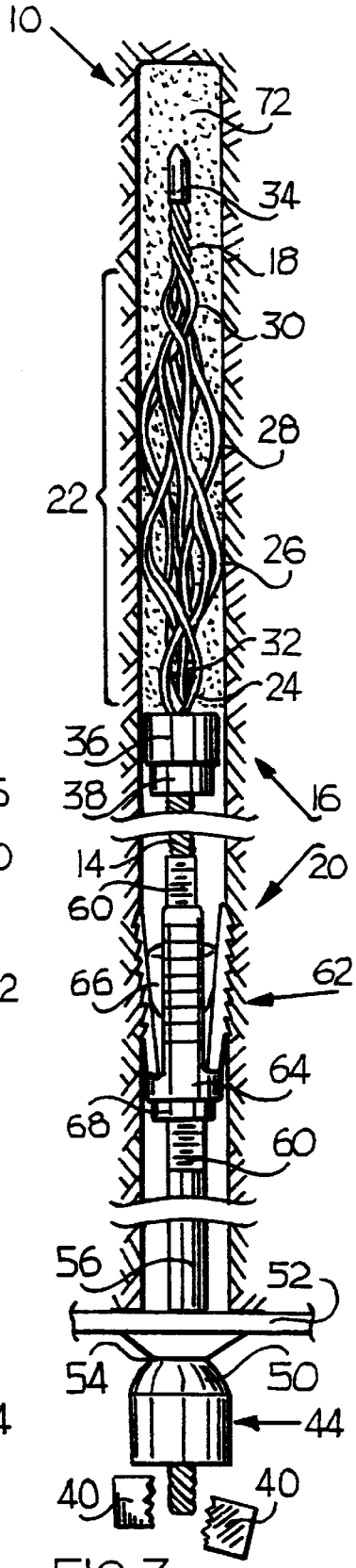
FIG. 3 is another side elevation view of the cable bolt shown in FIG. 1, illustrating failure of the drivehead at a predetermined torque.

A resin compactor 36 with a support member 38 is disposed intermediate to the upper portion 16 of the bolt 10. The resin compactor 36 may be cup-shaped as shown in FIGS. 1–3 and includes two parts or may include a cylindrical solid member having a central hole as disclosed in U.S. Pat. No. 5,288,176, incorporated herein by reference, or may include a washer and clamp as disclosed in U.S. Pat. No. 5,181,800, incorporated herein by reference.

A separate attached drivehead 40 is mounted onto a first end or free end 42 (FIG. 3) of the cable 14. The drivehead 40 includes an exterior drive surface which preferably has a polygonal cross section, such as a square or hexagon, so that the drivehead 40 can be readily driven by conventional mine roof bolt installing equipment (not shown). A suitable drivehead 40 is one of those disclosed in either of copending applications Ser. No. 08/585,319 filed Jan. 11, 1996 or Ser. No. 08/652,791 filed May 23, 1996 both incorporated herein by reference.

The drivehead 40 is mounted to the free end 42 of the cable 14 with sufficient attachment strength to permit rotation of the bolt 10 with a mine roof bolt installing machine, yet allows the drivehead 40 to break free from the cable 14 upon tensioning of the bolt 10 as described below. Preferably, the drivehead 40 includes a central bore (shown exaggerated in size in FIG. 4) having threads or ridges or other such projections (not shown) and may be press fitted onto the cable free end 42.

Figure 4:
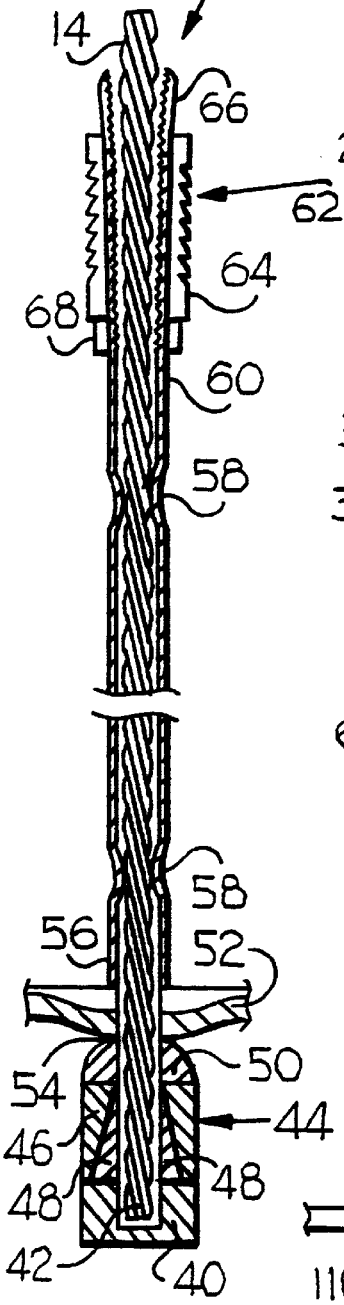
FIG. 4 is a side sectional view of a portion of the cable bolt shown in FIG. 2.

A barrel and wedge assembly 44 is preferably mounted on the cable 14 adjacent the drivehead 40. As depicted in FIG. 4, the barrel and wedge assembly 44 includes a substantially tubular barrel 46 having a tapered internal bore and internal locking wedges 48 having tapered outer surfaces. The locking wedges 48 surround and securely grip onto the cable 14 in a conventional manner. The barrel and wedge assembly 44 is a well-known and accepted mechanism for receiving the loading requirements of a mine roof bolt 10.

In operation, the barrel 46 is adjacent and supports a washer 50 and a bearing plate 52. Preferably, the washer 50 includes a spherical surface 54 and an opposing planar surface which abuts an end of the barrel and wedge assembly 44. The spherical surface 54 seats in an opening of the bearing plate 52. The spherical surface 54 of the washer 50 acts as a movable joint which allows the bolt to shift laterally. Preferably, the bearing plate 52 is an elastically deformable dome plate as disclosed in copending application Ser. No. 08/659,076, filed Jun. 3, 1996 which is incorporated herein by reference.

The drivehead 40 is used for rotating the bolt 10 whereas the load of the mine roof is borne by the barrel and wedge assembly 44. To maintain a minimal profile in the confines of a mine chamber, the bolt 10 preferably extends less than about an inch beyond the barrel and wedge assembly 44. This is achieved by abutment of the drivehead 40 against the barrel 46.

The bolt 10 additionally includes a shaft 56 having a central bore adapted to receive the cable 14 on an opposite side of the bearing plate 52 from the drivehead 40. As shown in FIG. 4, the shaft 56 is crimped or swaged to the cable 14 at a plurality of locations 58 (the degree of crimping or swaging shown exaggerated) along its length. The attachment of the shaft 56 to the cable 14 must be sufficiently strong to maintain attachment of the shaft 56 to the cable 14 so that when the cable 14 is rotated, the shaft rotates therewith as a unit. In certain situations where the geological conditions dictate, the shaft 56 may be fixed to the cable 14 along the length of the shaft or over the entire inner surface of the shaft. An end of the shaft 56 distal from the barrel and wedge assembly 44 includes external threads 60. The threads 60 are adapted to accept a mechanical anchor 62 having an expansion shell 64, an internally threaded plug 66 and an internally threaded stop washer 68. An outside diameter of the shaft 56 is sized to allow the mechanical anchor 62 to be threaded thereon and to allow the bolt 10 to be inserted into a conventional mine roof bore hole typically 1⅜ inches in diameter. Preferably, the nominal outside diameter of the shaft 56 is about ⅞ inch. The inside diameter of the shaft 56 is sized to accept the cable 14. The stop washer 68 is threaded onto the shaft 56 and supports the expansion shell 64 in a conventional manner. Suitable mechanical anchors are disclosed in U.S. Pat. Nos. 5,244,314 and 5,078,547, both incorporated herein by reference.

Returning to FIGS. 1–3, the length of the cable bolt 10 is determined by the geologic conditions of the rock formation to be supported. The length of the upper portion 16 of the cable bolt 10 having the mixing portion 20 and the length of the shaft 56 are likewise determined by the geologic conditions of the rock formation to be stabilized and the length of the resin cartridge used. In particular, the shaft 56 must be of a sufficient length such that the mechanical anchor 62 mounted thereon contacts stable rock when expanded. Typically, the cable bolt 10 is about eight to twenty feet long having a shaft 56 of about three feet in length.

FIG. 1 depicts installation of the cable bolt 10 with a resin cartridge 70 inserted into the blind end of the bore hole 12. The resin cartridge 70 preferably contains a hardenable resin and a catalyst in separate compartments (not shown) or other suitable grouting material. As will be described in more detail below, FIGS. 2 and 3 depict the cable bolt 10 after the resin cartridge 70 has been ruptured and the resin and catalyst are released to form mixed resin 72.

The cable bolt 10 is installed in a mine roof bore hole 12 as follows. The resin cartridge 70 is inserted into the blind end of the drilled bore hole 12. The cable bolt 10 is inserted into the bore hole 12 with a conventional bolting machine such that the resin cartridge 70 ruptures and the resin and the catalyst are released. During insertion, the drivehead 40 is rotated by the bolting machine to mix the resin and catalyst components to form mixed resin 72. The mixed resin 72 flows along the upper portion 16 of the cable 14 having the mixing portion 22 and is prevented from flowing further down the length of the cable 14 by the resin compactor 36. Because the shaft 56 is crimped or swaged to the cable 14 preventing relative axial movement between the cable 14 and the shaft 56, rotation of the drivehead 40 causes rotation of the cable 14 and shaft 56. Mixing of the resin is achieved during installation of the upper portion 16 with the bird cages 24, 26, 28 and 30. While the shaft 56 rotates, the plug 66 threads down the shaft 56 thereby urging the expansion shell 64 radially outward into gripping engagement with the wall of the bore hole 12. As the expansion shell 64 engages with the bore hole wall, the lower portion 20 of the cable bolt 10 between the mechanical anchor 62 and the drivehead 40 becomes tensioned. Engagement of the expansion shell 64 with the wall of the bore hole 12 typically occurs before the mixed resin 72 has set. Thus, the lower portion 20 of the cable bolt 10 may be tensioned before the upper portion 16 of the cable bolt 10 is fixed via the mixed resin 72 to the rock strata.

It is important that the resin 72 is completely mixed before the expansion shell 64 fully engages with the bore hole wall. Once the expansion shell 64 is fully engaged with the bore hole wall, it can no longer rotate nor can the cable 14 be further rotated. Thus the resin 72 must be completely mixed by the time the expansion shell 64 fully engages the bore hole wall.

To completely mix the resin 72, it is important to maximize the number of rotations experienced by the cable 14 before the mechanical anchor 62 is fully anchored. To achieve this goal, the pitch of the threads 60 or the number of threads per inch on the shaft 56 may be increased over that of conventional rock bolts which accept a mechanical anchor. In particular, conventional rock bolts typically have nine threads per inch whereas the shaft 56 preferably includes about twelve threads per inch. The additional number of threads per inch slows the rate of advance of the plug 66 relative to the expansion shell 64 during rotation of the bolt 10. This allows the bolt 10 to be rotated sufficiently to complete mixing of the resin 72 before the expansion shell 64 fully engages the bore hole wall preventing any further rotation.

The finer threads (about twelve per inch) on the shaft 56 result in an outer diameter of the threaded portion of the shaft slightly larger than an outer diameter of a conventional externally threaded rock bolt. A conventional mechanical anchor such as the J8 ⅞ available from Jennmar Corporation of Pittsburgh, Pa. (as disclosed in U.S. Pat. No. 5,244,314) may be used in a slightly modified form to accommodate the larger diameter finer threads.

In particular, the plug of the J8 ⅞ mechanical anchor may be modified for use on the bolt 10. When installed, the mechanical anchor 62 typically is located about three feet above the mine roof. The rock strata at that location (near a coal seam) is relatively soft compared to the rock strata at the blind end of the bore hole. Hence, the expansion shell 64 should be expanded to a greater extent than an expansion shell on a conventional rock bolt to ensure that the expansion shell 64 engages with stable rock. To achieve this goal, it is desirable to use a plug having a wider outside diameter which will force the expansion shell open to the desired degree. A suitable wider plug may be formed by reducing the length of the plug of a standard J8 ⅞ mechanical anchor by about ⅛ inch from the narrow end thereof. To accommodate the outside diameter of the shaft 56 bearing about twelve threads per inch and the wider plug, an inside diameter of the expansion shell 64 should be about 15⁄16 inch.

Another method of increasing the number of rotations of the bolt 10 prior to complete engagement of the expansion shell 64 with the bore hole is to decrease the thickness of the stop washer 68. Decreasing the thickness of the stop washer 68 will allow the stop washer 68 to move further down the threads 60 of the shaft during rotation of the bolt 10. This increased advancement results from a decrease in the frictional force between the threads 60 and the stop washer 68 due to the corresponding decrease in the thickness of the stop washer 68. Any advance of the stop washer 68 along the external threads 60 increases the number of rotations associated with installing the bolt 10. Furthermore, the expansion shell 64 requires less support than expansion shells installed on conventional rock bolts, hence a thinner stop washer 68 may be used.

As depicted in FIG. 3, the drivehead 40 may serve as a torque tension indicator for the cable bolt 10. In operation, the drivehead 40 is mounted on the free end 42 of the cable 14 resulting in an attachment between the drivehead 40 and the free end 42 of a predetermined strength. The drivehead 40 is rotated so that the expansion shell 64 engages the wall of the bore hole 12 and the lower portion 20 of the cable bolt 10 is tensioned. The drivehead 40 may be further rotated until the drivehead 40 fails or breaks off from the free end 42. The amount of torque required to be applied to the cable bolt 10 to cause the drivehead 40 to fail or break off is a function of the strength of the attachment between the drivehead 40 and the free end 42 of the cable 14. When the drivehead 40 fails, it may be assumed that the cable bolt 10 has received the predetermined degree of tension. If desired, the free end 42 may be cut off the cable 14 below the barrel and wedge assembly 44.

Figure 5:
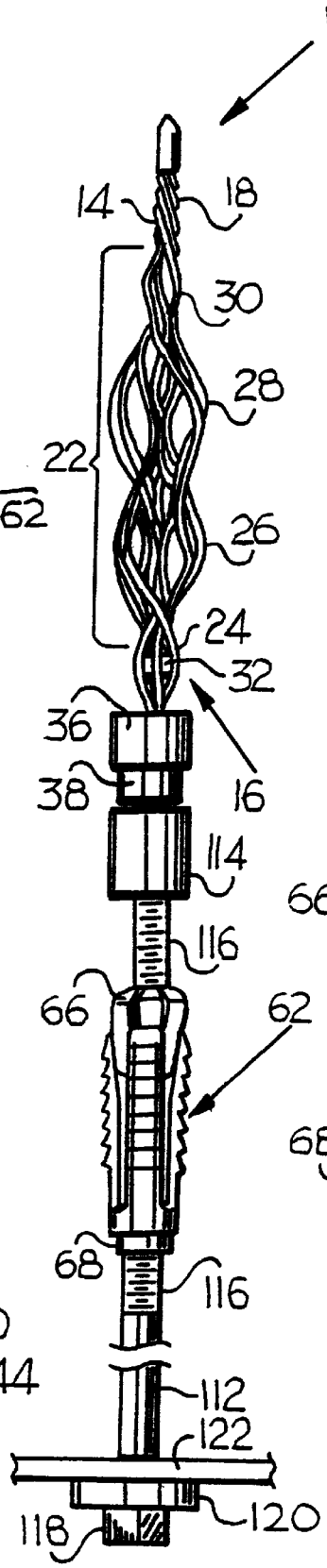
FIG. 5 is a side elevation view of a modified tensionable cable mine roof bolt.
Figure 6:
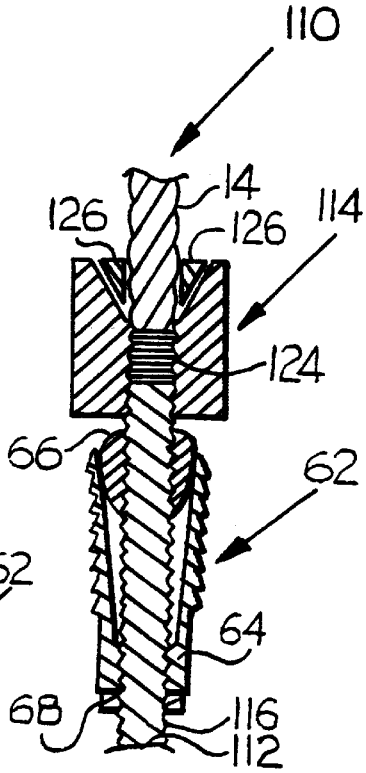
FIG. 6 is a side sectional view of a portion of the modified tensionable cable mine roof bolt depicted in FIG. 5.

A modified tensionable mine roof cable bolt 110 is depicted in FIGS. 5 and 6. The upper portion 16 of the cable bolt 110 is similar to the upper portion 16 of the cable bolt 10, however the cable 14 is coupled to a lower rod 112 via a coupler 114. The rod 112 includes external threads 116 having about twelve threads per inch which accommodate the mechanical anchor 62. A drivehead 118, preferably a square nut, is fixed to a free end of the rod 112. A washer 120 and a bearing plate 122 are positioned adjacent the drivehead 118 without need for a barrel and wedge assembly.

Referring to FIG. 6, the coupler 114 defines a central bore, a portion of the central bore shown at 124 is internally threaded to accept the externally threaded rod 112. Other mechanisms for fixing the rod 112 within the coupler 114 may be employed such as swaging, crimping, use of adhesives or other known techniques. Another portion of the coupler 114 is internally tapered and receives internal locking wedges 126 having tapered outer surfaces. The locking wedges 126 surround and securely grip the cable 14 in a conventional manner.

The cable bolt 110 is installed in a bore hole in a manner similar to installation of the cable bolt 10. However, rotation of the drivehead 118 imparts a direct rotation of the rod. The rotating rod causes rotation of the coupler 114 and the cable 14 coupled thereto. As the rod 112 rotates, the expansion shell 64 engages with the bore hole wall while the bird cages 24, 26, 28 and 30 mix the resin as occurs during installation of the cable bolt 10. As with the cable bolt 10, the lower portion between the mechanical anchor 62 and the drivehead 118 may be tensioned before the upper portion of the cable bolt 110 is fixed via the mixed resin to the rock strata.

The tensionable cable bolt of the present invention offers several distinct advantages over the tensionable bolts of the prior art. The cable bolt is substantially easier to fit into a bore hole than the elongated rods of the prior art systems. The cable bolt is additionally lighter and easier to transport. The cable bolt exhibits greater resin mixing and bonding capabilities by provision of bird cages. Furthermore, due to the flexibility of the cable, the cable bolt can be easily adjusted to bore holes of any length regardless of the space limitations in a mine. The strength capacity of cables exceeds conventional rebar and, therefore, cable is the preferred reinforcement for certain roof conditions.

Conventionally, the installation of resin grouted cable bolts requires three steps: (1) mixing the resin; (2) allowing the resin to set over a period of several minutes; and (3) tensioning the cable. The present invention allows these steps to be accomplished simultaneously. Because the expansion shell spreads upon installation and rotation of the cable bolt, the cable bolt is tensioned during installation and mixing of the resin. The conventional hold cycle previously used to allow the resin to cure before a bolt is tensioned is avoided. Furthermore, the mixing portion and resin grouting together provide a primary anchorage for the cable bolt and the expansion anchor provides a secondary anchorage of the cable bolt.

The cable bolt of the present invention may be used for primary support of a mine roof because it can be tensioned and can be installed by conventional mining machines. The correlation of the torque tension required to break the drivehead away from the cable with the attachment strength between the drivehead and the cable allows a predetermined load to be accurately applied to tension the cable bolt.

Although the present invention has been described in detail in connection to the discussed embodiments, various modifications may be made by one of ordinary skill in the art without departing from the spirit and scope of the present invention. Therefore, the scope of the present invention should be determined by the attached claims.

What is claimed is:

1. A tensionable cable mine roof bolt comprising:

an elongated member having an upper portion adapted to be resin grouted within a bore hole in rock and an intermediate portion having a mechanical anchor for engaging with the rock surrounding the bore hole, and an end portion having a bolt head drivable by mine roof bolt installation equipment, said upper portion comprising a length of multi-strand cable, whereby when said bolt is rotated, said elongated member rotates and said mechanical anchor engages with the rock surrounding the bore hole thereby tensioning said bolt and said upper portion simultaneously mixes resin within the bore hole.

2. The tensionable cable mine roof bolt as claimed in claim 1 wherein said bolt head comprises a drivehead attached to said end portion of said elongated member, whereby when resin is inserted into the bore hole and said drivehead is rotated by mine roof bolt installation equipment, said upper portion rotates and mixes the resin and said intermediate portion engages with the rock.

3. The tensionable cable mine roof bolt as claimed in claim 1 wherein said cable includes a first end, a second end and a mixing portion disposed between said first and second ends, and wherein said bolt further includes an externally threaded shaft attached to said cable, said mechanical anchor being threaded onto said threaded shaft.

4. The tensionable cable mine roof bolt as claimed in claim 3 wherein said shaft is hollow and said cable extends through said shaft.

5. The tensionable cable mine roof bolt as claimed in claim 4 wherein said drivehead is press fitted onto said cable first end.

6. The tensionable cable mine roof bolt as claimed in claim 4 further comprising a barrel and wedge assembly attached to said cable between said drivehead and said shaft.

7. The tensionable cable mine roof bolt as claimed in claim 6 wherein said drivehead is adapted to break away from said cable when said bolt is tensioned to a predetermined load.

8. The tensionable cable mine roof bolt as claimed in claim 4 wherein said shaft is swaged to said cable.

9. The tensionable cable mine roof bolt as claimed in claim 3 wherein said threaded shaft includes twelve threads per inch.

10. The tensionable cable mine roof bolt as claimed in claim 3 further comprising a coupler body coupling said cable to said threaded shaft.

11. The tensionable cable mine roof bolt as claimed in claim 3 wherein said cable includes a plurality of strands wrapped around each other and wherein said mixing portion comprises a region of said cable wherein said strands are spaced apart from each other.

12. The tensionable cable mine roof bolt as claimed in claim 11 wherein said mixing portion includes a plurality of regions in which said strands are spaced apart from each other.

13. The tensionable cable mine roof bolt as claimed in claim 12 wherein said cable includes a central strand and a plurality of surrounding strands and said bolt further comprises a nut, said nut being received on said central strand in one of said regions.

14. The tensionable cable mine roof bolt as claimed in claim 13 wherein said nut is positioned about three feet from said second end of said cable.

15. The tensionable cable mine roof bolt as claimed in claim 14 further comprising a sleeve mounted on said cable second end whereby an end of each said strand is fixed within said sleeve.

16. A tensionable cable mine roof bolt for insertion into a bore hole in rock and adapted to be resin grouted, said bolt comprising:

a bearing plate;

a barrel and wedge assembly supporting said bearing plate;

a multi-strand cable having a first end attached to said barrel and wedge assembly and having a resin mixing portion distal from said first end;

a drivehead mounted on said first end opposite said barrel and wedge assembly from said bearing plate;

an externally threaded shaft receiving said cable and secured to said cable between said bearing plate and said resin mixing portion; and a mechanical anchor threaded onto said shaft, wherein when resin is inserted into the bore hole and said bolt is rotated within the bore hole to mix the resin, said mechanical anchor engages the rock and tensions said bolt.

17. The tensionable cable mine roof bolt as claimed in claim 16 wherein said drivehead is releasably mounted on said cable.

18. The tensionable cable mine roof bolt as claimed in claim 17 wherein said drivehead is adapted to break away from said cable when said bolt is tensioned to a predetermined load.

19. The tensionable cable mine roof bolt as claimed in claim 16 wherein said shaft is swaged to said cable.

20. The tensionable cable mine roof bolt as claimed in claim 16 wherein said mixing portion includes a plurality of regions wherein said strands are spaced apart from each other.

21. The tensionable cable mine roof bolt as claimed in claim 20 wherein said cable includes a central strand and said bolt further comprises a nut, said nut being received on said central strand in one of said regions.

22. The tensionable cable mine roof bolt as claimed in claim 20 wherein prior to installation of said bolt in the bore hole, an outside diameter of one of said regions is larger than an inside diameter of the bore hole.

23. A method of installing a cable mine roof bolt in a bore hole formed in the rock of a mine roof comprising the steps of:

placing a resin cartridge into the bore hole;

inserting a cable mine roof bolt into the bore hole, the bolt including a cable and a drive head mounted on the bolt at a first end thereof, the cable including a resin mixing portion distal from the first end, the bolt further including a mechanical anchor mounted on the bolt at a position between the drive head and the resin mixing portion; and rotating the drive head for simultaneously (i) rotating the resin mixing portion to mix the resin and for (ii) engaging the mechanical anchor with the rock surrounding the borehole and tensioning the bolt between the mechanical anchor and the mine roof.

24. The method of installing a cable mine roof bolt as claimed in claim 23 further comprising tensioning the bolt to a predetermined load.

25. The method of installing a cable mine roof bolt as claimed in claim 24 wherein said step of tensioning the bolt to a predetermined load comprises rotating the drivehead until the drivehead breaks free from the bolt.

* * * * *